US005407278A

United States Patent [19]

Beer

[11] Patent Number: 5,407,278

[45] Date of Patent: Apr. 18, 1995

[54] DUAL COMPARTMENT EASILY OPENABLE FLEXIBLE PACKAGE

[75] Inventor: Jeffrey S. Beer, Perkiomenville, Pa.

[73] Assignee: Fres-Co System USA, Inc., Telford, Pa.

[21] Appl. No.: 165,235

[22] Filed: Dec. 10, 1993

[51] Int. Cl.[6] ..... B65D 30/22

[52] U.S. Cl. ..... 383/38; 383/210; 206/219

[58] Field of Search ..... 383/38, 39, 210, 211; 206/219

[56] References Cited

U.S. PATENT DOCUMENTS

| | | | |
|---|---|---|---|
| 2,756,875 | 7/1956 | Yochim | 206/219 |
| 3,861,522 | 1/1975 | Llewellyn et al. | 206/219 |
| 4,488,647 | 12/1984 | Davis . | |
| 4,518,087 | 5/1985 | Goglio . | |
| 4,667,453 | 5/1987 | Goglio . | |
| 4,705,174 | 11/1987 | Goglio . | |
| 4,776,455 | 10/1988 | Anderson et al. | 383/38 X |
| 4,953,708 | 9/1990 | Beer et al. . | |
| 5,209,347 | 5/1993 | Fabisiewicz et al. | 383/38 X |
| 5,353,927 | 10/1994 | Stupar et al. | 383/38 X |

*Primary Examiner*—Allan N. Shoap
*Assistant Examiner*—Jes F. Pascua
*Attorney, Agent, or Firm*—Caesar, Rivise, Bernstein, Cohen & Pokotilow, Ltd.

[57] ABSTRACT

Flexible packages, each having a hollow interior including a pair of compartments for holding respective granular or powdered products isolated from each other. The packages are formed of flexible sheet material and comprises a front panel, a rear panel, and an intermediate panel. The front and rear panels each have a top edge portion, a bottom edge portion, and a pair of sides which are connected together. The bottom edge portions of the front and rear panels are sealed together. The intermediate panel has a pair of side edges and a bottom edge portion, with one of the side edges sealed to the package along one of the sides, and the other of the side edges is peelably sealed to the rear panel in one embodiment and to the front panel in another embodiment. The top edge portion of the intermediate panel is permanently sealed to the top edge portion of one panel and is peelably sealed to the top edge portion of the other panel. The bottom edge portion of the intermediate panel is permanently sealed to the front and rear panels. The space between the intermediate panel and the panel to which is peelably secured forms one compartment and the space between the intermediate panel and the other panel forms the other compartment. A hand peelable seal extends across the top portion of the panels to releasably seal the materials within the compartments and to enable the package to be readily peeled open to simultaneously pour the contents of the compartments therefrom.

15 Claims, 8 Drawing Sheets

FIG. 1
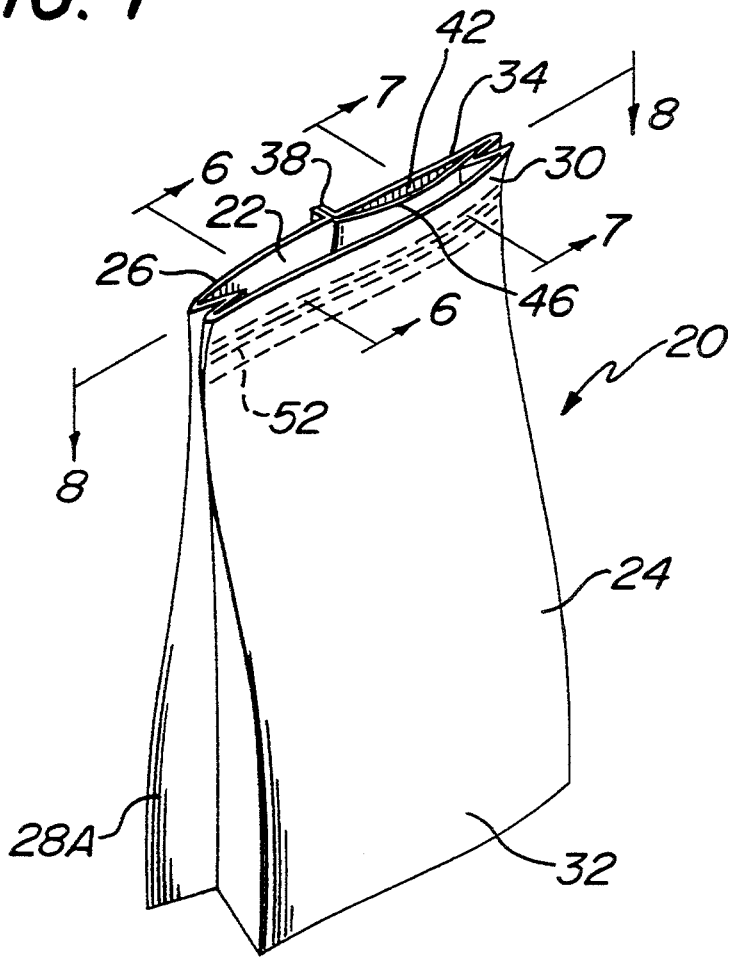
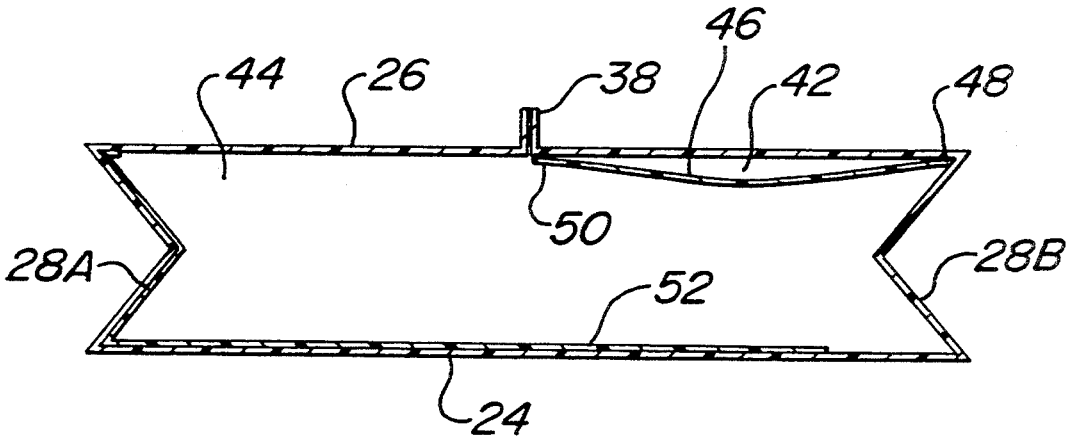
FIG. 8

FIG. 13
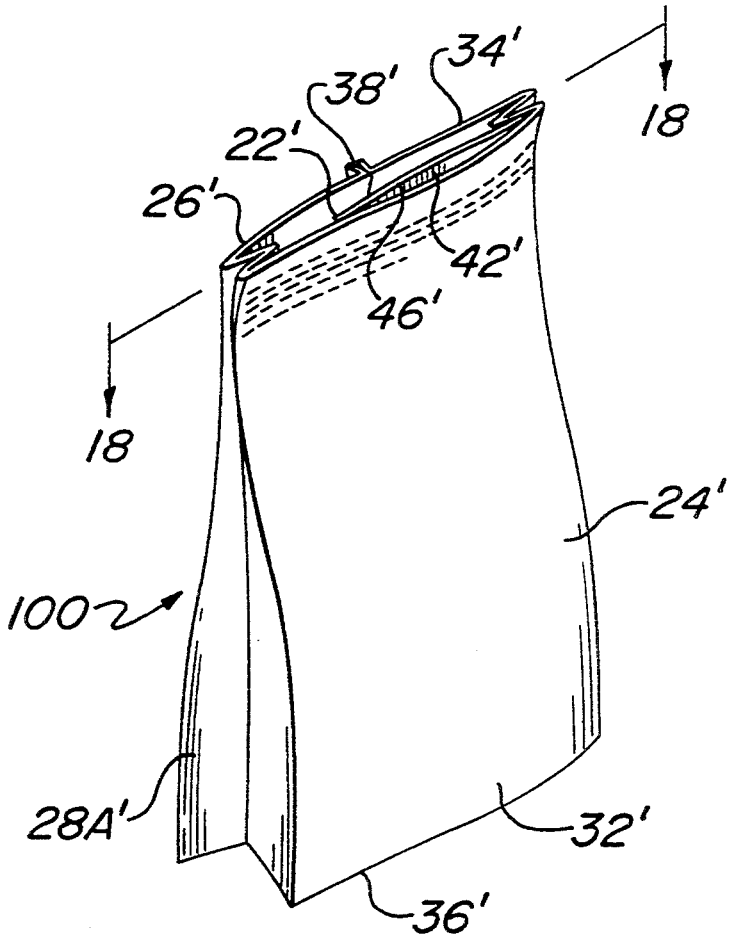
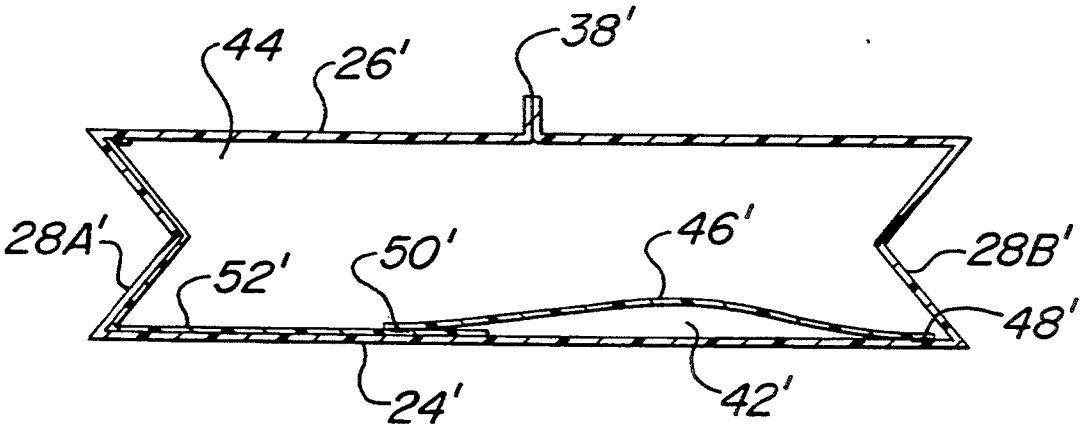
FIG. 18

FIG. 19
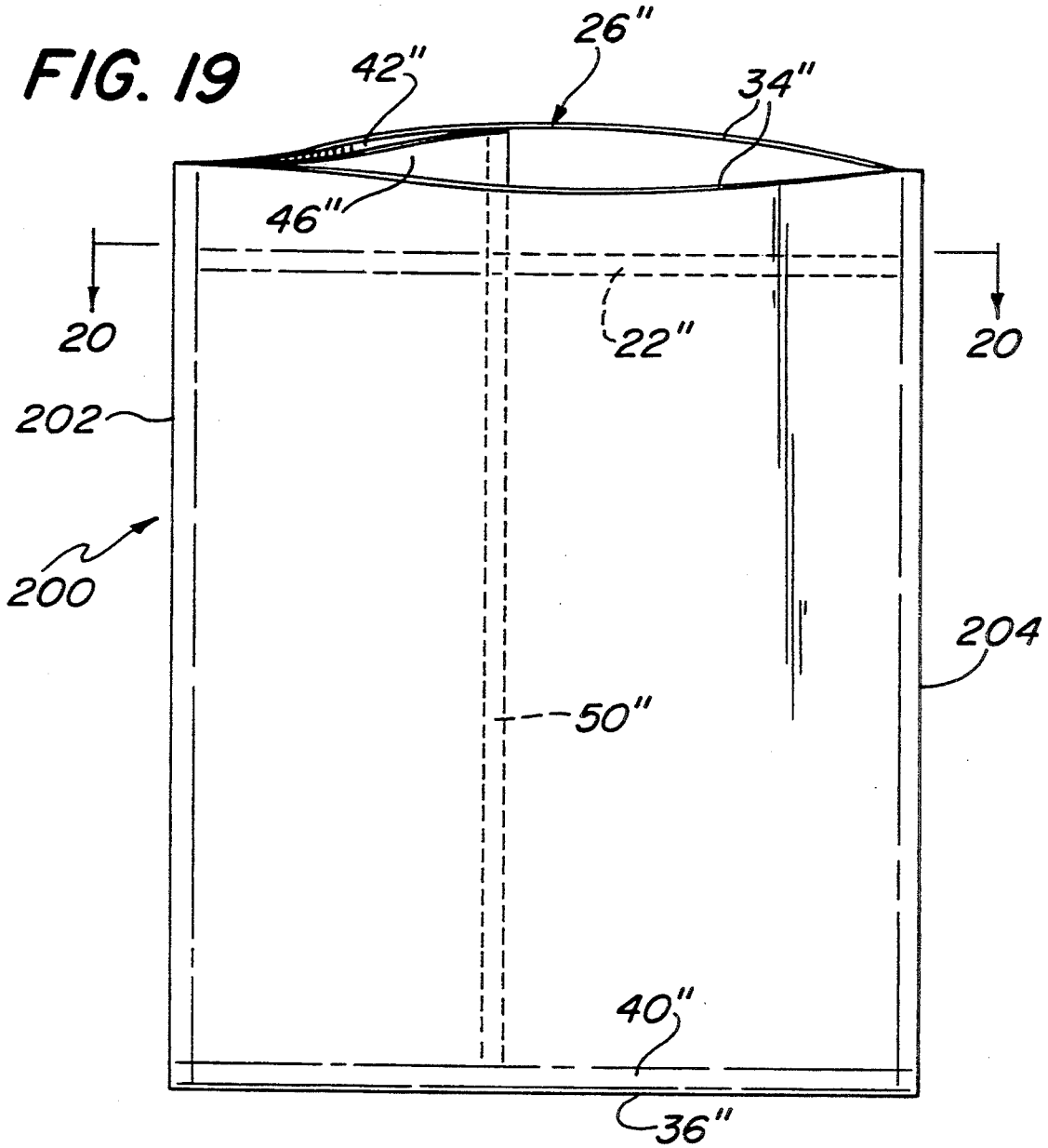
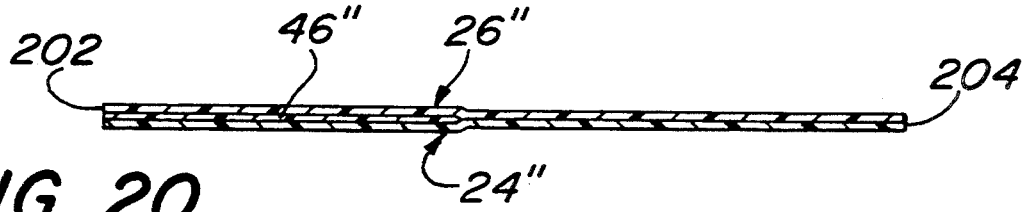
FIG. 20
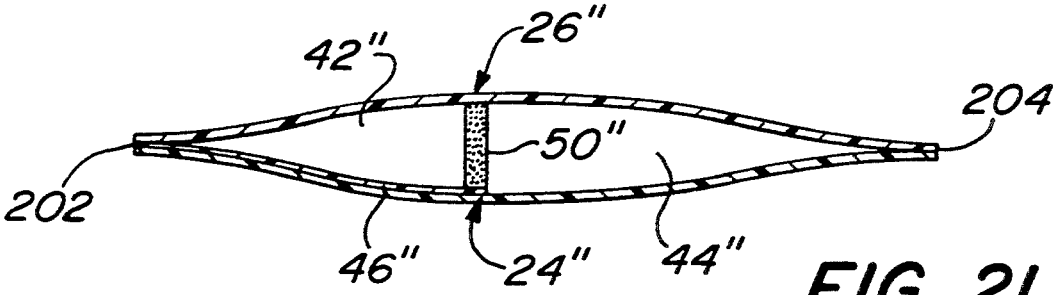
FIG. 21

DUAL COMPARTMENT EASILY OPENABLE FLEXIBLE PACKAGE

BACKGROUND OF THE INVENTION

This invention relates to flexible packages and more particularly to a flexible package for holding two materials isolated from each other within the package, with the package being readily peelable open to enable the materials to be poured therefrom for mixing together.

Flexible containers formed of sheet materials have gained wide acceptance in the trade for holding chemicals or other air perishable materials therein. One common type of flexible package container is the so-called gussetted package. That package is arranged to be filled and sealed to hold the contents of the package under vacuum. Typically such packages are formed from a web of flexible stock material, e.g., polyethylene, polyester, polypropylene, metal foil, and combinations thereof in single or multiple plies, into a tubular body, having a face panel, a back panel, and a pair of gussetted sides. Each gussetted side is formed by a pair of gusset sections and a central fold edge interposed between a pair of outer fold edges. The lower end of many such prior art gussetted packages are commonly permanently sealed, e.g., heat sealed, along a line extending transversely across the width of the package close to the bottom edge of the package.

The top of the package may be sealed transversely across the entire width of the package in a number of manners to maintain the vacuum seal, but nevertheless be readily openable to provide access to the contents of the package.

The following prior art relates to flexible packaging with means to provide an opening into the interior thereof for access to the materials held within the packaging: U.S. Letters Pat. No. 4,488,647 (Davis), 4,518,087 (Goglio), 4,667,453 (Goglio), 4,705,174 (Goglio), and 4,953,708 (Beer).

While the aforementioned packages are suitable for their intended purposes, they are of very little utility for applications wherein two materials are to be held within the package and have to be kept separated or isolated from each other until ready for use.

OBJECTS OF THE INVENTION

Accordingly, it is a general object of this invention to provide a flexible package which overcomes the disadvantages of the prior art.

It is a further object of this invention to provide a flexible package for holding two free flowing granular or powdered materials or products within two compartments in the same package, with the compartments keeping those materials or products isolated from each other until the package is opened.

It is a further object of this invention to provide a package for holding two free flowing granular or powdered products isolated from each other while providing easy access to those products by means of hand manipulation of the package.

It is a further object of this invention to provide a package for holding two free flowing granular or powdered products isolated from each other and which includes a mouth portion which can be readily pulled apart to provide simultaneous access to those products so that they can be poured from the package together for mixing and use.

SUMMARY OF THE INVENTION

These and other objects of the instant invention are achieved by providing a flexible package having a hollow interior including a pair of compartments. Each of the compartments is arranged for holding a respective material therein isolated from the material in the other compartment.

The package is formed of flexible sheet material and comprises a front panel, a rear panel, and an intermediate panel. Each of the front and rear panels has a pair of sides which are connected together, a top edge portion, and a bottom edge portion. The bottom edge portions of the front and rear panels are connected together by a bottom seal line. The intermediate panel has a pair of side edges and a bottom edge portion.

Both of the side edges of the intermediate panel are releasably sealed along the length thereof to a selected one of the front and rear panels. The bottom edge portion of the intermediate panel is sealed along the length thereof to at least the selected one of the front and rear panels, whereupon the space between the intermediate panel and the selected one of the front and rear panels forms one of the compartments, while the space between the intermediate panel and the other of the front and rear panels forms the other of the compartments.

The package also includes a releasable, e.g., hand peelable, seal extending across the top portion of the panels to releasably seal the materials within the compartments.

In two preferred embodiments of the invention the packages are gussetted and in a third preferred embodiment of the invention the package is non-gussetted.

DESCRIPTION OF THE DRAWING

FIG. 1 is an isometric view of one embodiment of a gussetted package for holding two material separated from each other constructed in accordance with this invention, with the package being shown in a partially completed state prior to filling it;

FIG. 8 is an enlarged sectional view taken along line 8—8 of FIG. 1;

FIG. 13 is an isometric view, similar to FIG. 1, but showing a more preferred embodiment of a gussetted package for holding two material separated from each other constructed in accordance with this invention, with the package being shown in a partially completed state prior to filling it;

FIG. 18 is an enlarged sectional view taken along line 18—18 of FIG. 13;

FIG. 19 is an isometric view of a non-gussetted package for holding two material separated from each other constructed in accordance with this invention, with the package being shown in a partially completed state prior to filling it;

FIG. 20 is a sectional view taken along line 20—20 of FIG. 19 showing the mouth of the package prior to its being sealed; and FIG. 21 is a sectional view also taken along line 20—20 of FIG. 19 but showing the mouth of the package after it has been sealed.

DETAILED DESCRIPTION OF THE PREFERRED EMBODIMENTS

Figure 2:
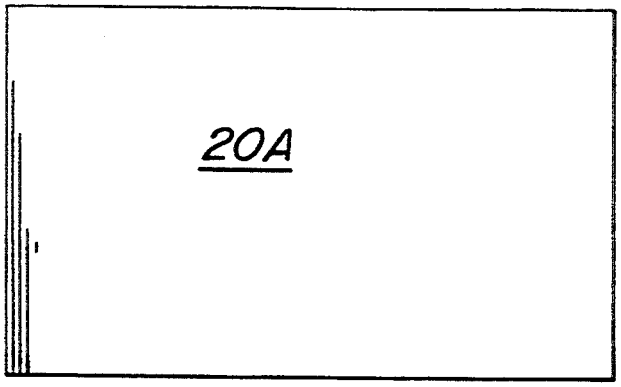
FIG. 2 is a reduced plan view of a web or blank of flexible material forming the package of FIG. 1.

Referring now to various figures of the drawing where like reference numerals refer to like parts there is shown at 20, 100, and 200 in FIGS. 1, 13, and 19, respectively, packages constructed in accordance with the subject invention. The packages are each arranged to hold two granular or powdered materials or products 10A and 10B (e.g., see FIG. 12) within respective compartments (to be described later) within the package so that those products are kept separate and isolated from each other until the package is opened. Moreover, each package includes a readily openable, e.g., hand-peelable, mouth (to be described later) for providing easy access to the products 10A and 10B within the package so that they can be poured from the package simultaneously for mixing and use.

The packages 20 and 100 are each fabricated from a single web or sheet of any suitable flexible sheet material, e.g., plastic, paper, foil or any combination thereof, in single or multiple plies, to provide an air tight package and to form the permanent and peelable seams (to be described later), while the package 200 is fabricated from two such sheets. In any case the material forming the package may also include any type of conventional additional layers for abuse resistance, heat resistance, and for enabling reverse printing.

Figure 11:
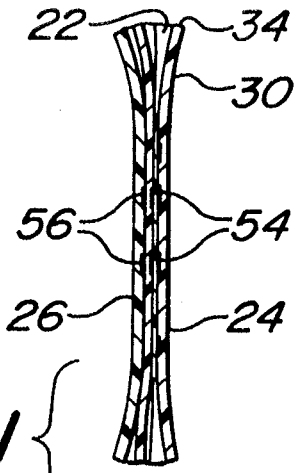
FIG. 11 is an enlarged sectional view taken along line 11—11 of FIG. 9.
Figure 9:
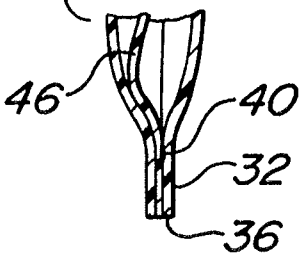
FIG. 9 is an isometric view of a package constructed in accordance with this invention shown in its completed state after filling and sealing.
Figure 9:
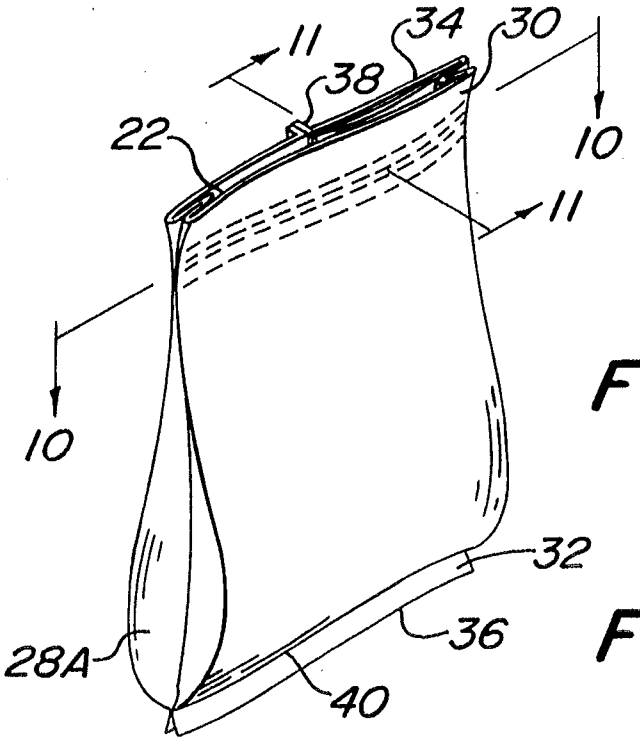
Figure 10:
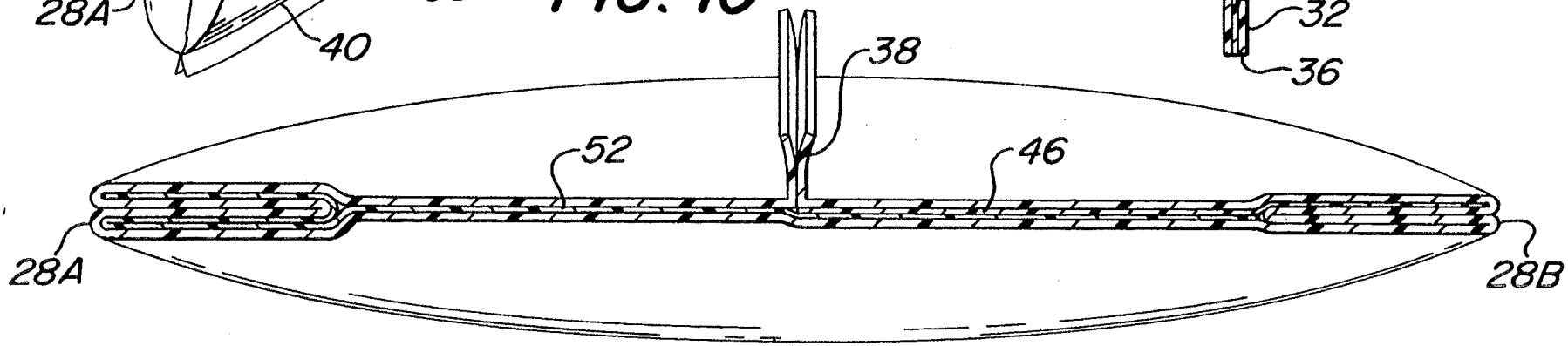
FIG. 10 is an enlarged sectional view taken along line 10—10 of FIG. 9.

The packages 20 and 100 are gussetted packages of identical construction except for the means for forming the two compartments thereof. In the interests of brevity the common components of the packages 20 and 100 will be given the same reference numbers, with the components of the package 100 being identified by a ' suffix after the number. Thus, the packages 20 and 100 basically comprise a face or front panel 24/24', a rear panel 26/26', a pair of identical gussetted sides 28A/28A' and 28B/28B', a top end portion 30/30' (FIGS. 1, 9, 11, 13), and a bottom end portion 32/32' (FIGS. 9, 11, and 13). The top end portion 30/30' of the package 20/100 forms a mouth 22/22' and terminates in a top marginal edge 34/34'. It is through the mouth 22/22' of the package that the contents 10A and 10B may be poured when the mouth is opened. The bottom end portion 32/32' of the package 20/100 terminates in a bottom marginal edge 36/36' (FIGS. 9, 11 and 13). If desired, one or more one-way venting valves (not shown) may be included in any suitable portion of the package to enable air or any gases which may be produced by the material(s) contained within the sealed package 20 to vent to the ambient air without any air gaining ingress to the package's interior.

The front panel 24/24', rear panel 26/26' (FIGS. 6–8, and 18), and the two gussetted sides 28A/28A' and 28B/28B' (FIGS. 1 and 8) of the package are all integral portions of a single sheet or web of a flexible material, like that shown in FIGS. 2 and 14, which is fabricated, folded and seamed to form a tubular body (as will be described later). The rear panel 26/26' of the packages 20/100 includes a longitudinally extending, vertical seam 38/38'. The seam 38/38' is formed by portions of the web material contiguous with the vertical marginal edges the sheet or web which are brought into engagement with each other and are secured to one another via any conventional sealing technique, such as heat sealing or welding.

The mouth of the package is arranged to releasably sealed closed after the web of material has been formed into the tube so that its two compartments can be filled with the products 10A and 10B from the open bottom end portion 32/32'. Once this is accomplished the bottom end portion of the package is permanently sealed closed by a transversely extending bottom seam 40. As can be seen in FIG. 9 the seam 40 extends the full width of the package 20 and includes the gussetted sides 28A and 28B. The package 100 includes an identical bottom seam, although it is not shown in the figures. In accordance with a preferred embodiment of this invention the bottom seam of packages 20/100 is formed using any conventional sealing technique, e.g., heat sealing, like that used to form the seam 38/38'.

As can be seen clearly in FIGS. 8, 12, 18, and 18 the packages 20 and 100 include two compartments 42/42' and 44/44', for holding the products 10A and 10B, respectively, isolated from each other until the mouth 22/22' of the package is peeled open, at which time seams (to be described later) forming two marginal edges of the compartment 44/44' are opened. As will be described in detail later when this action is taken and the package inverted the products 10A and 10B will simultaneously pour out of the mouth of the package for mixing and use.

Figure 12:
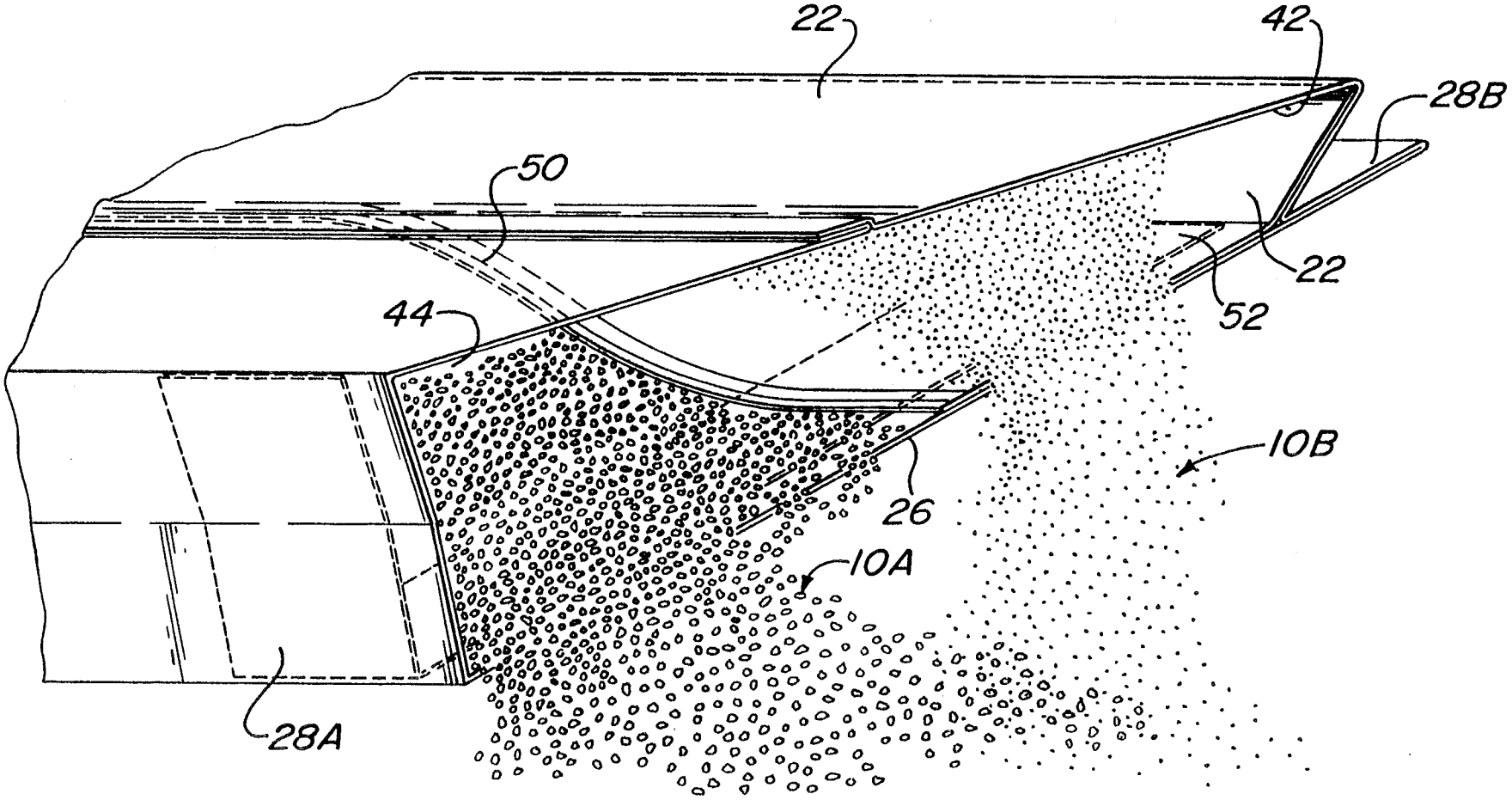
FIG. 12 is an isometric view of the top portion of the package of FIG. 1 shown after the mouth of the package has been peeled open to enable the pouring of the two materials from the package.

Referring now to FIGS. 1, 8 and 12 the details of the compartments 42 and 44 of the package 20 will now be described. A description of the compartments 42' and 44' of the package 100 will follow later. Thus, as can be seen in FIGS. 1, 8 and 12 the compartments 42 and 44 are formed by an intermediate or compartmental panel 46, formed of a flexible sheet material, one face of which forms a permanent seal with the front panel 24 and the other face of which forms a peelable seal with the rear panel 26 extending the full width of the intermediate panel and the full height of the package, i.e., from the bottom edge portion 32 to the top edge portion 30. The intermediate panel 46 is of a width less than that of either the front or rear panels and includes one side marginal edge which is secured by a vertically extending seam 48 to the rear panel 26 contiguous with the side gusset 28B. The seam 48 is preferably formed using any suitable conventional sealing technique, such as that used to form the seams 38 and 40. The other side marginal edge of the intermediate panel is releasably secured by a vertically extending hand peelable seam 50 to the rear panel 26 immediately adjacent the seam 38. The bottom marginal edge (not shown) of the intermediate panel 46 is permanently secured to the rear panel along the entire bottom marginal edge of the intermediate panel by the bottom seam 40 after filling (as will be described later).

When the intermediate panel is secured to the rear panel by the seams 48 and 50 it forms the two compartments 42 and 44. In particular, and as will be appreciated by those skilled in the art, the compartment 42 is defined by the space between intermediate panel 46 and the rear panel 26 portion over which the intermediate panel is disposed, and the compartment 44 is defined by the remainder of the interior of the package, i.e., the space between the intermediate panel 46, the side gusset 28B, the front panel 24, the side gusset 28A, and the portion of the rear panel 26 on the opposite side of the vertical seam 38 from the intermediate panel. When so constructed the compartment 42 is considerably smaller than the compartment 44, e.g., in the embodiment shown the compartment 42 holds 15% of the contents of the package 20 while the compartment 44 holds 85% of the contents of the package.

The mouth 22 of the package is formed by a strip 52 of flexible material which is permanently secured by a pair of horizontally disposed heat seals 54 (FIGS. 6 and 7) to the inside surface of the front panel 24 along the top edge portion 30. The flexible strip is formed of a peelable sealing material 52, such as that disclosed in U.S. Letters Pat. No. 4,705,174 (Goglio), whose disclosure is incorporated by reference herein. As can be seen clearly in FIG. 8 the strip 52 extends from the point at which the inner fold of the side gusset 28B meets the front panel when the mouth is sealed closed to the side gusset 28B and through that gusset to the rear panel 26. The outer surface of the intermediate panel 46 along the entire width of the top edge portion of the intermediate panel is releasably, e.g., peelably, sealed to the strip 52 by a pair of horizontally disposed, peelable heat seal seams 56. The seams 56 extend beyond the side marginal edge 50 of the intermediate panel 46 to releasably seal the rear panel to the front panel along the top edge portions thereof and to seal the folded portions of the side gusset 28A to the contiguous portions of the front and rear panels, thereby completely sealing the mouth 22 of the package. All of the seams 56 are arranged to be readily peeled open by hand.

As should be appreciated from the foregoing when the mouth of the package is peeled open by hand force on the upper edges 34 of the front and rear panels the inner surface of the upper end portion of the front panel will be released, i.e., peeled away from the inner surface of the rear panel, thereby opening the top of the compartment 44. The upper marginal edge of the intermediate panel will remain secured to the inner surface of the front panel, but will be released, i.e., peeled away, from the inner surface of the rear panel, thereby opening the top of the compartment 42. In addition, the opening of the mouth of the package also causes the vertical peelable seam 50 of the side marginal edge of the intermediate panel to open from the top down, thereby further contributing to the opening of the compartment 42. This action also ensures that the contents 10A of the compartment 42 mix well with the contents 10B of the compartment 44 as they are poured simultaneously out of the package.

Figure 3:
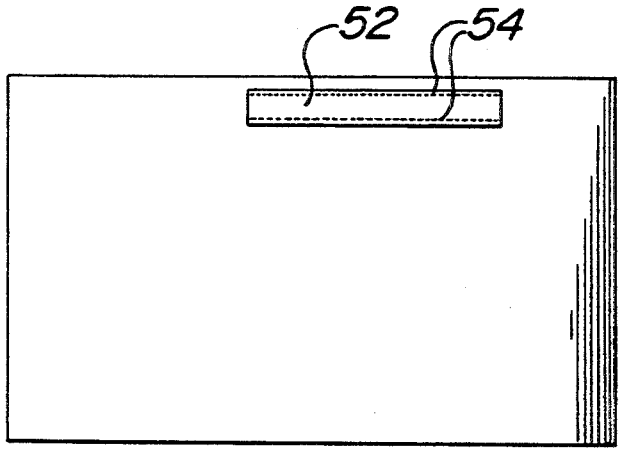
FIG. 3 is a reduced plan view of the blank of flexible material shown in FIG. 2 but at a subsequent point in the fabrication process.
Figure 4:
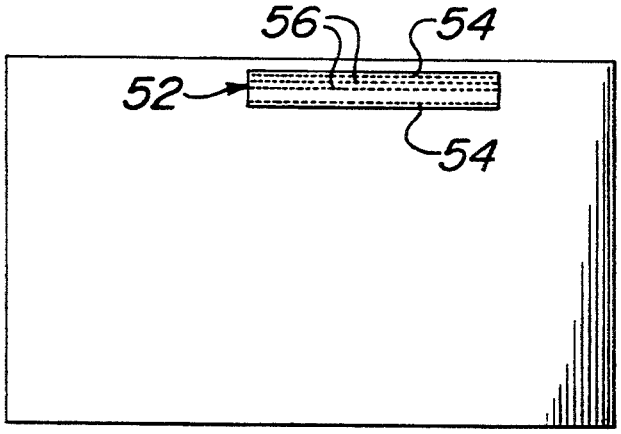
FIG. 4 is a reduced plan view of the blank of flexible material shown in FIG. 2 but at a further subsequent point in the fabrication process.
Figure 5:
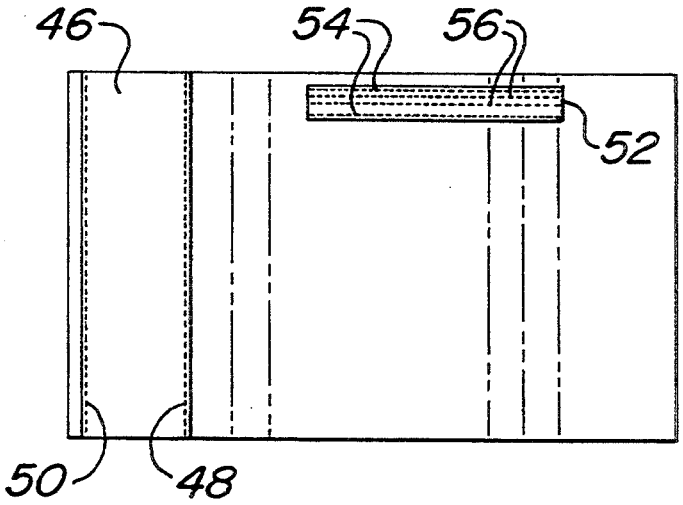
FIG. 5 is a reduced plan view of the blank of flexible material shown in FIG. 2 but at yet a further subsequent point in the fabrication process.
Figure 6:
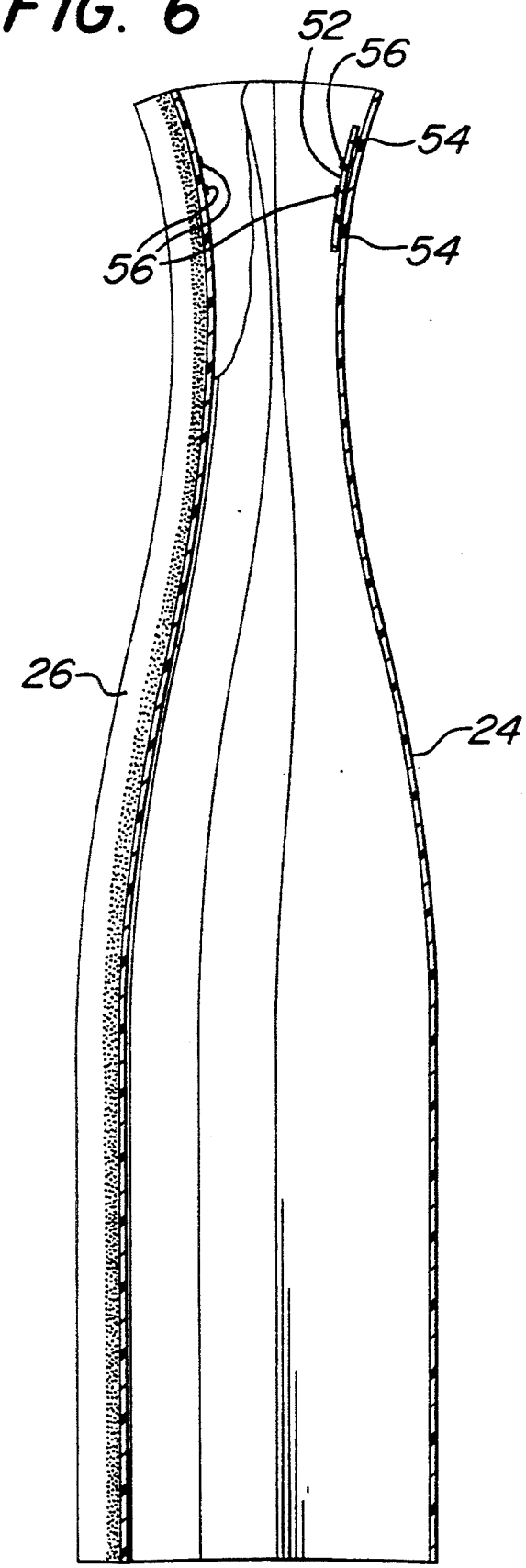
FIG. 6 is an enlarged sectional view taken along line 6—6 of FIG. 1.
Figure 7:
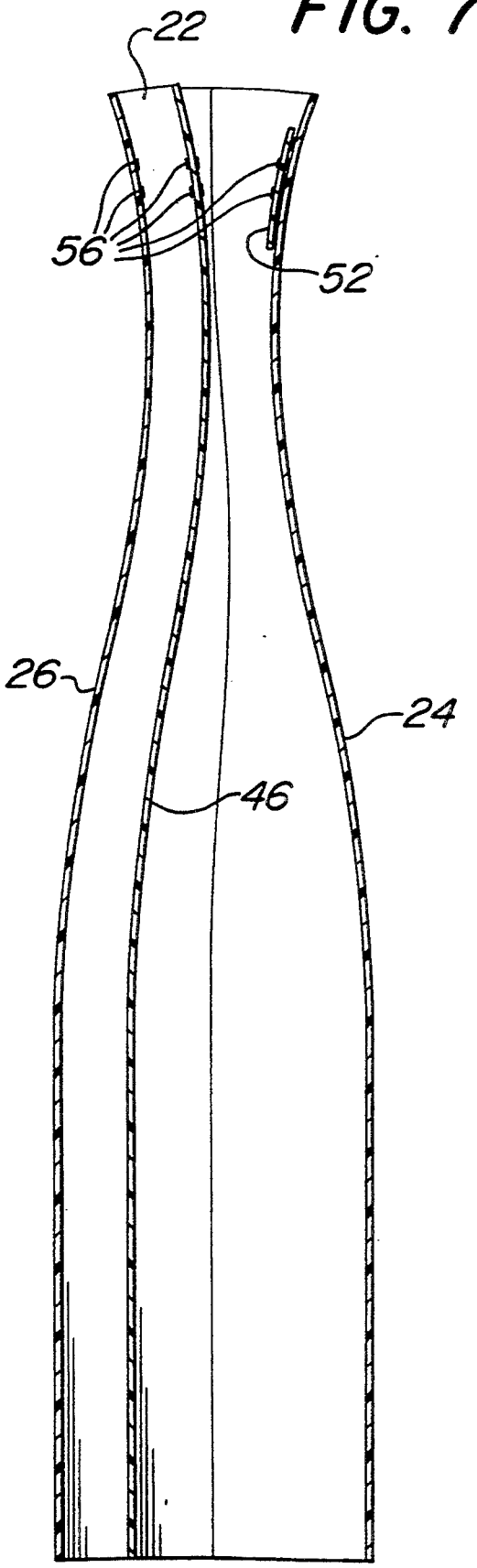
FIG. 7 is an enlarged sectional view taken along line 7—7 of FIG. 1.

The fabrication of the package 20 will best be understood by reference to FIGS. 2–5. As can be seen in FIG. 2 a blank or web 20A of any suitable flexible material for forming the front panel 24, rear panel 26 and side gussets 28A and 28B is selected and sized to the suitable dimensions. Then the flexible strip of peelable sealing material 52 is permanently secured to the blank by the pair of heat seals 56 as shown in FIG. 3. The intermediate panel 46 is then secured to the blank by the vertical heat seal 48 and the peelable heat seal 50 as shown in FIG. 5. The blank is then folded along the fold lines (shown by the phantom lines in FIG. 5) to form the gussets 28A and 28B and to complete the tube. The side marginal edges of the blank are then sealed together to form the vertical back seam 38. The mouth of the package is then sealed closed, the package inverted, i.e., the bottom end is directed upward, and the material 10A is introduced through the open bottom of the package into the bottom of the compartment 42. The material 10B is similarly introduced into the bottom of compartment 44. Once the compartments are full the bottom heat seal 40 is made, thereby sealing the contents 10A and 10B within the compartments 42 and 44, respectively, of the package.

Referring now to FIGS. 13 and 18 the details of the compartments 42' and 44' of the package 100 will now be described. Thus, as can be seen in those figures the compartments 42' and 44' are formed by an intermediate or compartmental panel 46', formed of a flexible sheet material, one face of which forms a permanent seal with the rear panel 26' and the other face of which forms a peelable seal with the front panel 24' extending the full width of the intermediate panel and the full height of the package, i.e., from the bottom edge portion 32' to the top edge portion 30'. The intermediate panel 46' is of a width less than that of either the front or rear panels and includes one side marginal edge which is secured by a vertically extending seam 48' to the front panel 24' contiguous with the side gusset 28B'. The other side marginal edge of the intermediate panel is releasably secured by a vertically extending hand peelable seam 50' to the front panel 24' adjacent the other side of the package. The bottom marginal edge (not shown) of the intermediate panel 46' is permanently secured to the front panel along the entire bottom marginal edge of the intermediate panel by the bottom seam after filling in the same manner as described earlier.

When the intermediate panel is secured to the front panel by the seams 48' and 50' it forms the two compartments 42' and 44'. The compartment 42' is defined by the space between intermediate panel 46' and the front panel 24' portion over which the intermediate panel is disposed, and the compartment 44' is defined by the remainder of the interior of the package. When so constructed the compartment 42' is somewhat smaller than the compartment 44', albeit larger than the compartment 42 of the package 20.

The mouth 22' of the package 100 is formed by a strip 52' of flexible material which is permanently secured by a pair of horizontally disposed heat seals 54' to the inside surface of the rear panel 26' along the top edge portion 30'. The flexible strip is formed of the same peelable sealing material as strip 52 and extends from the point at which the outer fold of the side gusset 28A' meets the rear panel through that gusset to an intermediate point in the front panel 24' within the marginal edge 50' of the compartment 42'. The outer surface of the intermediate panel 46 along the entire width of the top edge portion of the intermediate panel is releasably, e.g., peelably, sealed to the strip 52' by a pair of horizontally disposed, peelable heat seal seams 56'. The seams 56' extend beyond the side marginal edge 50' of the intermediate panel 46' to releasably seal the front panel to the rear panel along the top edge portions thereof and to seal the folded portions of the side gusset 28A to the contiguous portions of the front and rear panels, thereby completely sealing the mouth 22' of the package 100. All of the seams 56' are arranged to be readily peeled open by hand.

As should be appreciated from the foregoing when the mouth of the package 100 is peeled open by hand force on the upper edges 34' of the front and rear panels the inner surface of the upper end portion of the rear panel will be released, i.e., peeled away from the inner surface of the front panel, thereby opening the top of the compartment 44'. The upper marginal edge of the intermediate panel will remain secured to the inner surface of the rear panel, but will be released, i.e., peeled away, from the inner surface of the front panel, thereby opening the top of the compartment 42'. In addition, the opening of the mouth 22' of the package 100 also causes the vertical peelable seam 50' of the side marginal edge of the intermediate panel to open from the top down, thereby further contributing to the opening of the compartment 42'. This action also ensures that the contents 10A of the compartment 42 mix well with the contents 10B of the compartment 44 as they are poured simultaneously out of the package.

Figure 14:
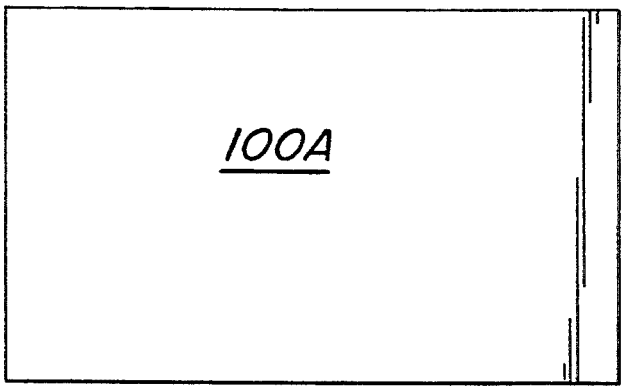
FIG. 14 is a reduced plan view, similar to FIG. 2, but showing a web or blank of flexible material forming the package of FIG. 13.
Figure 15:
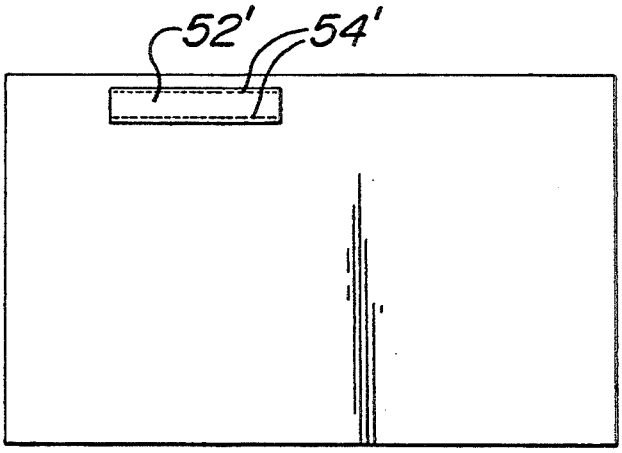
FIG. 15 is a reduced plan view, similar to FIG. 3, showing the blank of flexible material shown in FIG. 14 at a subsequent point in the fabrication process of the package of FIG. 13.
Figure 16:
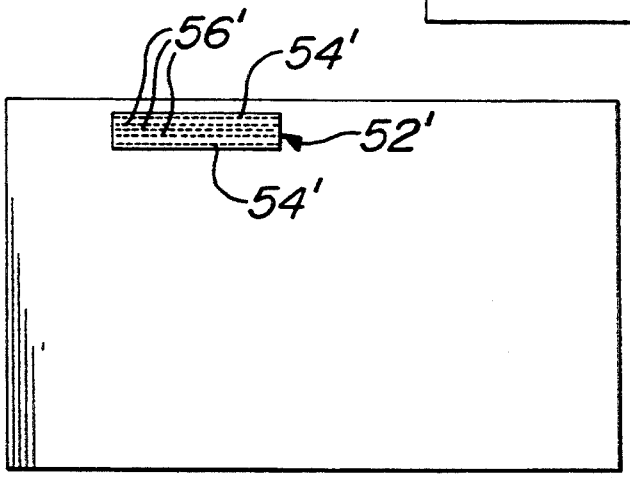
FIG. 16 is a reduced plan view, similar to FIG. 4, showing the blank of flexible material shown in FIG. 15 at a further subsequent point in the fabrication process of the package of FIG. 13.
Figure 17:
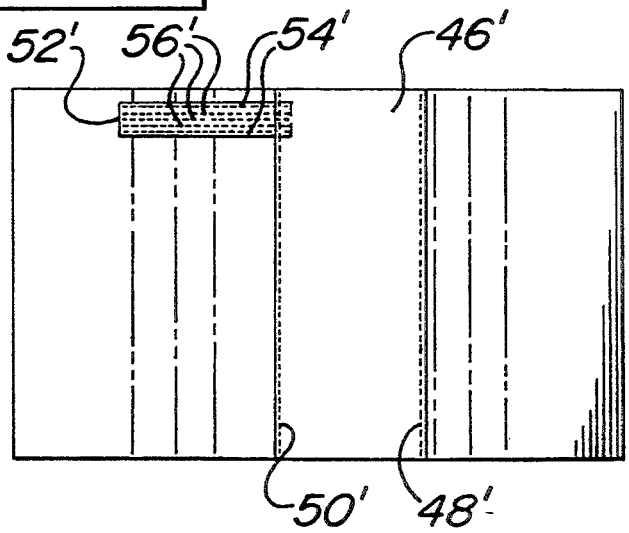
FIG. 17 is a reduced plan view, similar to FIG. 5, showing the blank of flexible material shown in FIG. 16 at yet a further subsequent point in the fabrication process of the package of FIG. 13.

The fabrication of the package 100 will best be understood by reference to FIGS. 14–17. As can be seen in FIG. 14 a blank or web 100A of any suitable flexible material for forming the front panel 24' rear panel 26' and side gussets 28A' and 28B' is selected and sized to the suitable dimensions. Then the flexible strip of peelable sealing material 52' is permanently secured to the blank by the pair of heat seals 56' as shown in FIG. 15. The intermediate panel 46' is then secured to the blank by the vertical seals 48' and 50' as shown in FIG. 17. The blank is then folded along the fold lines (shown by the phantom lines in FIG. 17) to form the gussets 28A' and 28B' and to complete the tube. The side marginal edges of the blank are then sealed together to form the vertical back seam 38'. The mouth 22' of the package is then sealed closed, the package inverted, i.e., the bottom end is directed upward, and the material 10A is introduced through the open bottom of the package into the bottom of the compartment 42'. The material 10B is similarly introduced into the bottom of compartment 44'. Once the compartments are full the bottom heat seal is made, thereby sealing the contents 10A and 10B within the compartments 42' and 44', respectively, of the package.

In FIGS. 19–21 there is shown a non-gussetted embodiment of a package 200 constructed in accordance with this invention. The package 200 is very similar in construction to the packages 20 and 100 except for the fact that it does not include side gussets and is formed of two sheets of flexible material instead of a single sheet. Thus, in the interests of brevity the common components of the packages 20 and 200 will be given the same reference numbers, with the components of the package 200 being identified by a "suffix after the number, while different components will be given reference numbers without the" suffix.

The package 200 basically comprises a face or front panel 24'' a rear panel 26'' a pair of sides 202 and 204, a top end portion 30'' and a bottom end portion 32''. The top end portion 30'' of the package 200 forms a mouth 22'' and terminates in a top marginal edge 34''. It is through the mouth 22'' of the package that the contents 10A and 10B may be poured when the mouth is opened. The bottom end portion 32'' of the package 200 terminates in a bottom marginal edge 36''. If desired, one or more one-way venting valves (not shown) may be included in any suitable portion of the package to enable air or any gases which may be produced by the material(s) contained within the sealed package 200 to vent to the ambient air without any air gaining ingress to the package's interior.

The front panel 24'' is formed of a sheet of flexible material having a peelable inner surface at least at the top portion of the sheet, i.e., the portion of the sheet forming a portion of the mouth 22'' of the package 200, while the rear panel 26'' is formed of another sheet of such material. The two sheets are secured to each other along their sides 202 and 204 by permanent heat seals.

The mouth 22'' of the package is arranged to releasably sealed closed after the package with its two compartments is formed so that those compartments can be filled with the products 10A and 10B from the open bottom end portion 32''. Once this is accomplished the bottom end portion of the package is permanently sealed closed by a transversely extending bottom seam 40'' which extends the full width of the package 200.

As can be seen clearly in FIGS. 19 and 21 the package 200 includes two compartments 42'' and 44'', for holding the products 10A and 10B, respectively, isolated from each other until the mouth 22'' of the package is peeled open, at which time seams (to be described later) forming two marginal edges of the compartment 44'' are opened. As described earlier when this action is taken and the package inverted the products 10A and 10B will simultaneously pour out of the mouth of the package for mixing and use.

Like the packages described earlier the compartments 42'' and 44'' are formed by an intermediate or compartmental panel 46'', formed of a flexible sheet material, one face of which forms a permanent seal with the front panel 24'' and the other face of which forms a peelable seal with the rear panel 26'' extending the full width of the intermediate panel and the full height of the package, i.e., from the bottom edge portion 32'' to the top edge portion 30''. The intermediate panel 46'' is of a width less than that of either the front or rear panels and includes one side marginal edge which is secured by the vertically extending seam 202 to the front and rear panels 26. The other side marginal edge of the intermediate panel 46'' is releasably secured by a vertically extending hand peelable seam 50'' to the rear panel 26''. The bottom marginal edge of the intermediate panel 46'' is permanently secured to the front and rear panels along the entire bottom marginal edge of the intermediate panel by the bottom seam 40'' after the package is filled.

When the intermediate panel is secured to the front and rear panels as just described it forms the two compartments 42'' and 44'', with the compartment 42'' being defined by the space between intermediate panel 46'' and the rear panel 26'' portion over which the intermediate panel is disposed, and the compartment 44'' is defined by the remainder of the interior of the package. When so constructed the compartment 42'' is smaller than the compartment 44''.

Since the inner surface at of the front and rear panels 24'' and 26'', respectively, is peelable, the mouth 22'' of the package can be readily peeled open by hand force on the upper edges 34'' of the front and rear panels. This action causes the inner surface of the upper end portion of the front panel to be released, i.e., peeled away from the inner surface of the rear panel, thereby opening the top of the compartment 44''. The upper marginal edge of the intermediate panel will remain secured to the inner surface of the front panel 24'', but will be released, i.e., peeled away, from the inner surface of the rear panel 26'', thereby opening the top of the compartment 42'' as shown in FIG. 21. In addition, the opening of the mouth of the package also causes the vertical peelable seam 50'' of the side marginal edge of the intermediate panel to open from the top down, thereby further contributing to the opening of the compartment 42''. This action also ensures that the contents 10A of the compartment 42'' mix well with the contents 10B of the compartment 44'' as they are poured simultaneously out of the package.

It should be pointed out at this juncture that the packages described heretofore are merely exemplary of various types of packages which can be constructed in accordance with the teachings of this invention. Thus, the packages may be of any size and shape, gussetted or not, and may be used for holding two types of pourable materials. In fact, packages can be constructed in accordance with this invention to provide more than two compartments so that more than two pourable materials can be kept separated from each other within the package. Moreover, the packages may be constructed of any type of suitable material, e.g., paper, plastic, and/or foil materials and combinations thereof, as required by the products to be packaged. Further still, the packages may be constructed to hold two products of varying volume by extending the intermediate panel (compartmental flap) more or less across the back panel of the package or across the front panel. The packages may also incorporate a folded flap at the sealed mouth to protect the peelable seal and/or form a carrying handle. As mentioned earlier, the packages may include a valve to allow air or gas to exhaust from the package. In fact, two such valves may be incorporated in the package, one for each compartment.

Without further elaboration the foregoing will so fully illustrate my invention that others may, by applying current or future knowledge, adopt the same for use under various conditions of service.

I claim:

1. A flexible package having a hollow interior including a pair of compartments, each of said compartments being arranged for holding a respective material therein isolated from the material in the other compartment, said package being formed of flexible sheet material and comprising a front panel, a rear panel, and an intermediate panel, each of said front and rear panels having a pair of sides which are connected together, a top edge portion, and a bottom edge portion, with the bottom edge portions of said front and rear panels being connected together by a bottom seal line, said intermediate panel having a pair of side edges and a bottom edge portion, one of said side edges of said intermediate panel being sealed along the length thereof to a portion of Said package along one of said sides, the other of said side edges of said intermediate panel being releasably sealed along the length thereof to a selected one of said front and rear panels, said intermediate panel being non-releasably sealed to the other of said front and rear panels, said bottom edge portion of said intermediate panel being sealed along the length thereof to at least said selected one of said front and rear panels, whereupon the space between said intermediate panel and said selected one of said front and rear panels forms one of said compartments, and whereupon the space between said intermediate panel and the other of said front and rear panels forms a portion of the other of said compartments, said package including a releasable seal extending across the top portion of said panels to releasably seal said compartments and to permit opening of said compartments upon release of said releasable seal.

2. The package of claim 1 wherein said one of said side edges of said intermediate panel is permanently sealed along the length thereof to said selected one of said front and rear panels.

3. The package of claim 1 wherein said intermediate panel is permanently sealed to one of said front and rear panels along the top edge portion thereof.

4. The package of claim 3 wherein the other of said side edges of said intermediate panel is releasably sealed to said rear panel, and wherein said top edge portion of said intermediate panel is permanently sealed to said front panel along the top edge of said front panel.

5. The package of claim 3 wherein the other of said side edges of said intermediate panel is releasably sealed to said front panel, and wherein said top edge portion of said intermediate panel is permanently sealed to said rear panel along the top edge of said rear panel.

6. The package of claim 1 wherein said releasable seals are readily peelable by hand.

7. The package of claim 1 comprising a strip of flexible material permanently secured to one of said front and rear panels across at least a portion of said top portion thereof, with said top edge portion of said intermediate panel being permanently sealed to said flexible strip.

8. The package of claim 1 wherein said package is gussetted, with said front and rear panels being connected by respective gusset folds at said sides, each of said folds comprising a central fold edge interposed between a pair of outer fold edges.

9. The package of claim 1 additionally comprising a vertical seal extending along said rear panel from the top edge portion thereof to the bottom edge portion thereof, said vertical seal being a permanent seal.

10. The package of claim 1 wherein each of said seals is a heat seal.

11. The package of claim 1 wherein said intermediate panel is of a width less than either of said front and rear panels.

12. The package of claim 4 wherein said intermediate panel is of a width less than either of said front and rear panels.

13. The package of claim 5 wherein said intermediate panel is of a width less than either of said front and rear panels.

14. The package of claim 1 wherein said front an rear panels are formed from an integral sheet of flexible material.

15. The package of claim 1 wherein said front an rear panels are each formed of a separate sheet of flexible material, with said sheets being secured together along said sides.

* * * * *